United States Patent [19]

Gutierrez

[11] 4,448,414

[45] May 15, 1984

[54] BASEBALL BASE

[76] Inventor: Pete Gutierrez, 420 NW. Witham Dr., Corvallis, Oreg. 97330

[21] Appl. No.: 361,733

[22] Filed: Mar. 25, 1982

[51] Int. Cl.[3] ..... A63B 71/00

[52] U.S. Cl. ..... 273/25

[58] Field of Search ..... 273/25, 212; 404/6-13

[56] References Cited

U.S. PATENT DOCUMENTS

| | | | |
|---|---|---|---|
| 1,244,044 | 10/1917 | Falconer, Sr. . | |
| 1,670,123 | 5/1928 | Ranseen | 273/212 |
| 2,084,775 | 2/1937 | Orefice . | |
| 2,405,492 | 8/1946 | Corbett . | |
| 2,947,540 | 8/1960 | Henry . | |
| 3,126,203 | 3/1964 | Bourret . | |
| 3,204,958 | 9/1965 | Velasquez . | |
| 3,466,039 | 9/1969 | Golomb . | |
| 3,508,747 | 4/1970 | Orsatti . | |
| 3,572,705 | 3/1971 | Wyble . | |
| 3,815,905 | 6/1974 | Golomb . | |
| 3,862,756 | 1/1975 | Selliken . | |
| 3,938,804 | 2/1976 | Willett . | |
| 3,971,558 | 7/1976 | Gardetto . | |
| 4,060,244 | 11/1977 | Graham . | |
| 4,162,789 | 7/1979 | Hollaway . | |

OTHER PUBLICATIONS

BOLCO Safety Bases Catalogue, (Team and Institutional Edition) Effective Aug. 1, 1977.

Jack Corbett Hollywood Bases, From Sportsways, A Division of Pittman Rubber Company, 11/75.

*Primary Examiner*—Richard J. Apley
*Assistant Examiner*—Chris Coppens
*Attorney, Agent, or Firm*—Klarquist, Sparkman, Campbell, Leigh & Whinston

[57] ABSTRACT

A baseball base is disclosed having an anchor which is adapted to be permanently fixed in the ground, and a bag of a resilient material which snaps on to the anchor when in use. The anchor has a platform and a bag engaging portion with outwardly flaring walls which project upwardly from the platform. The bag has internal wall surfaces which define a recess in the undersurface of the bag. These wall surfaces are flared to accommodate the mounting and dismounting of the bag to the anchor portion. Ribs project into the recess from the undersurface of the bag and limit the depth of insertion of the anchor into the recess. These ribs also reinforce the bag and trap pockets of cushioning air between the anchor and bag. In addition, the bottom of the bag engages the anchor platform when the bag is in place to aid in supporting the bag. Also, a shelf portion of the bag, which surrounds the interior perimeter of the recess, engages the anchor and provides further support for the bag. Both the bag engaging portion of the anchor and the recess are of rectangular horizontal cross section with truncated corners.

5 Claims, 3 Drawing Figures

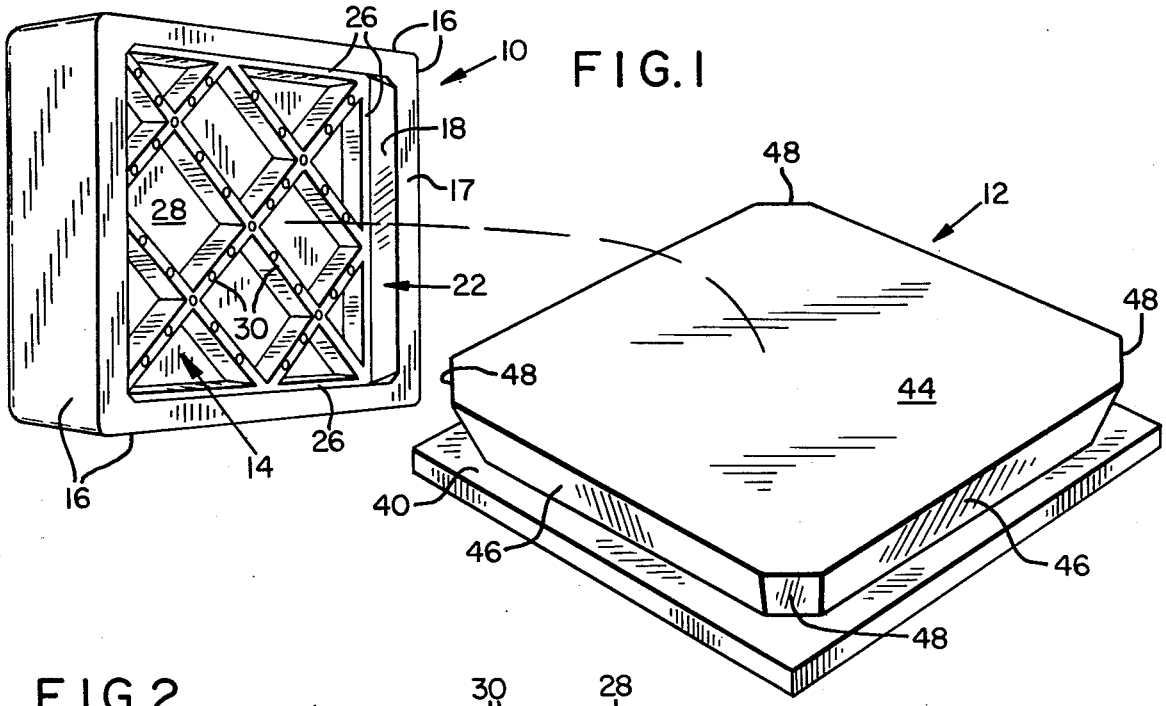
FIG. 1
FIG. 2
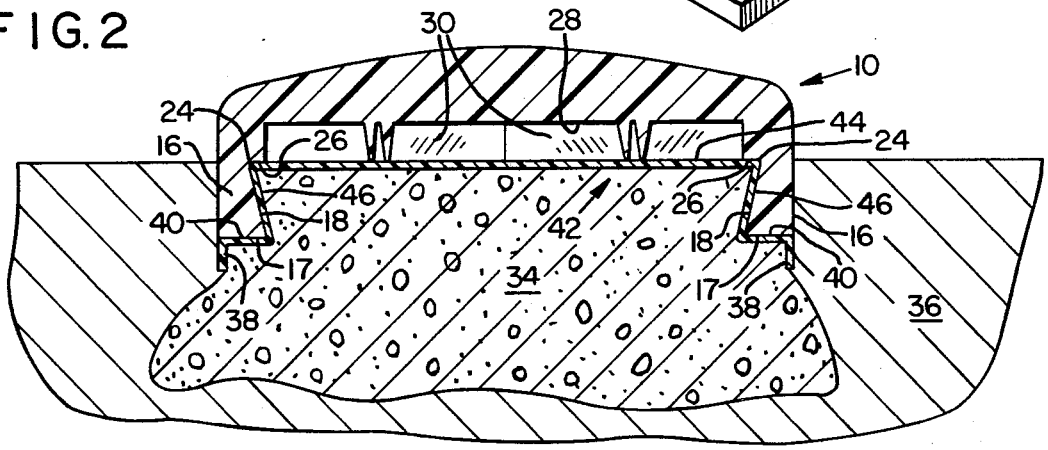
FIG. 3
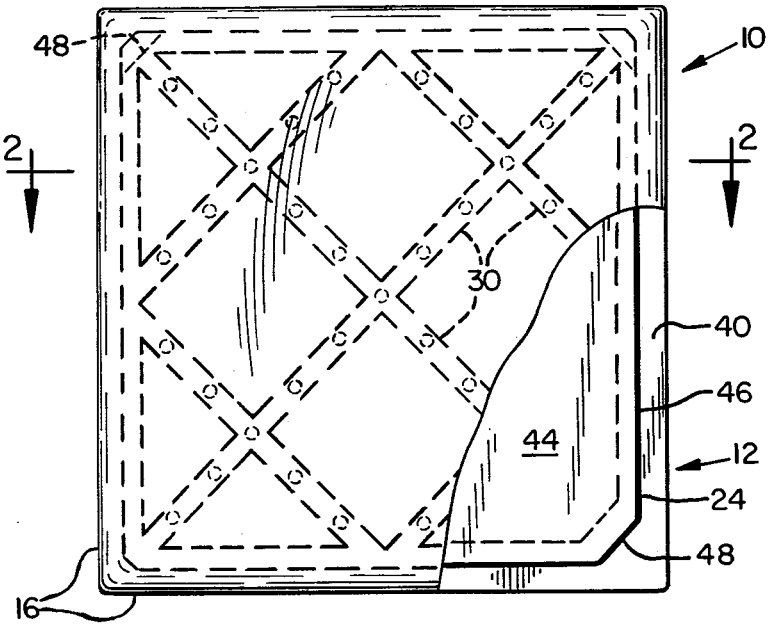

BASEBALL BASE

BACKGROUND OF THE INVENTION

This invention relates to a baseball base of the type having an anchor portion adapted to be positioned in the ground, and a bag portion which is releasably secured to the anchor portion.

Baseball is an extremely popular sport. For this reason, baseball diamonds are located throughout the United States and the world. Because of the importance of the sport, it is desireable to provide improved equipment, such as baseball bases having advantages over known bases. For example, in playgrounds, it is often necessary to remove the bases after use to prevent them from being lost, damaged or stolen. Thus, a base which has improved characteristics making it easy to install and remove is advantageous. The base of the present invention has improved features which facilitate its use.

SUMMARY OF THE INVENTION

It is an object of the present invention to provide an improved baseball base comprised of a stationary anchor member, and a bag member which is easy to install and remove from the anchor member, as desired.

A further object of the invention is to provide a bag which is attached to the anchor in a manner that minimizes the chances of the bag separating from the anchor as the game is played.

Another object of the invention is to provide a relatively mechanically simple and easily manufactured baseball base.

A still further object of the invention is to provide a baseball base with a bag of enhanced durability.

Still another object of the invention is to provide a baseball base with a cushioned bag.

A further object of the invention is to provide a baseball base with a bag which is easy to store between uses.

Another object of the invention is to provide an anchor which establishes the elevation of a bag which is mounted thereto.

A still further object of the invention is to provide an anchor which supports a substantial portion of the bag.

These and other objects, features and advantages of the invention will become apparent with reference to the following drawing.

BRIEF DESCRIPTION OF THE DRAWINGS

FIG. 1 is an exploded perspective view of a baseball base in accordance with the invention, including a bag member and an anchor member;

FIG. 2 is a cross-sectional view through the baseball base of the invention taken along lines 2—2 of FIG. 3; and FIG. 3 is a top plan view of the baseball base of FIG. 1, with the bag member mounted to the anchor member, and with a portion of the bag member broken away for clarity.

DESCRIPTION OF THE PREFERRED EMBODIMENT

With reference to the figures, a baseball base in accordance with the invention includes a bag member or bag 10 of a resilient material such as polyurethane foam coated with a hard skin, for example, a polyurethane elastomer. The base also includes a stationary anchor portion or anchor 12, adapted to be fixed in the ground. As described in greater detail below, the bag 10 and anchor 12 are designed to snap together to releasably mount the bag in position for use.

With reference to FIGS. 1 and 2, a recess 14 is provided and occupies a major portion of the undersurface of the bag 10. Walls 16, having interior surfaces 18, bound the perimeter of the recess. For reasons explained below, the walls 18 flare outwardly away from one another in a direction from the recessed opening 22, to a location 24 within the recess. At this location, the walls extend inwardly in a horizontal direction to form a shelf 26 around the perimeter of recess 14. From the inner edge of shelf 26, the walls 18 extend upwardly to a horizontal surface 28 which bounds the upper reaches of the recess. Plural reinforcing ribs (FIGS. 2 and 3) project downwardly from the surface 28 into the recess. These ribs are positioned in a lattice-work pattern for reinforcing purposes. Also, as can be seen in FIG. 3, the lower edge of the ribs 30 terminate at the elevation of the shelf 26.

Anchor 12 is preferably of a hollow construction and may be of a durable plastic material, such as acrylobutadiene styrene (ABS). When installed, as shown in FIG. 3, concrete or other setting material 34 occupies the hollow interior of the anchor and fixedly positions it in the ground 36. The anchor also includes a rectangular perimeter platform 40 and a bag engaging portion 42 which projects upwardly from the platform. Legs 38 project downwardly from the platform and are embedded in the concrete to aid in fastening the anchor. The bag engaging portion includes an upper horizontal surface 44, and walls 46 which flare outwardly from the platform 40 to the upper surface 44. In other words, the horizontal cross section through the bag engaging portion 42 increases in dimension moving upwardly away from the platform.

Bag 10 is installed on anchor 12 as follows. The opening 22 leading to recess 14 is sized somewhat smaller than the largest horizontal cross section of the bag engaging portion 42. As a result, the walls 16 are spread slightly as the bag is mounted to the anchor with the bag engaging portion 42 being inserted within recess 14. When completely installed, as shown in FIG. 3, the ribs 30, and shelf 26, rest on the upper anchor surface 44 so that the bag 10 is firmly and securely supported. In addition, the lower surfaces 17 of walls 16 rest on the platform 40 for added support. Furthermore, because these members limit the depth to which the bag is inserted, the elevation of the bag is established precisely by the elevation of the upper surface 44 of the anchor. Also, as shown in FIG. 3, the anchor is preferably set at or below grade. Thus, when a base runner slides into the base, he hits the exposed portion of the bag 10. Furthermore, the ribs 30 trap pockets of air between them and the upper surface 44 of the anchor, thereby cushioning the bag.

As can be seen in FIG. 1, the corners of anchor 12 are truncated at 48. The recess 14 is similarly truncated at the corners. Consequently, the bag 10 is thicker at its corners, and less subject to tearing at such locations.

Having illustrated and described the principles of my invention with reference to one preferred embodiment, it should be apparent to those persons skilled in the art that such invention may be modified in arrangement and detail without departing from such principals. I claim as my invention all such modifications as come within the true spirit and scope of the following claims.

I claim:

1. A baseball base comprising:

anchor means adapted for positioning in the ground, said anchor means having an upright upper bag engaging portion;

resilient bag means defining a recess in its under surface, the opening leading to the recess being sized less than the size of the largest horizontal cross section through the upper bag engaging portion, such that the portion of the bag surrounding the recess opening stretches as the bag means receives the upper bag engaging portion within the recess to thereby releasably retain the bag means in engagement with the upper bag engaging portion;

said upper bag engaging portion being of progressively increasing horizontal cross section from the bottom of such portion to the top of such portion and in which the recess is of progressively increasing horizontal cross section from the recess opening upwardly to a first location spaced above the recess opening;

said bag means including means for limiting the depth of insertion of the bag engaging portion into the recess; and said bag means including means for providing plural cushioning air pockets between the upper surface of the upper bag engaging portion and the upper boundary of the recess.

2. A baseball base according to claim 1 including plural spaced ribs projecting into the recess from the undersurface of said bag means, said ribs being positioned to engage the upper surface of the upper bag engaging portion to limit the depth of insertion of the bag engaging portion into the recess, said ribs also trapping cushioning air therebetween.

3. A baseball base according to claim 2 in which said bag means defines a horizontal shelf positioned within the recess at the first location so as to engage the upper surface of the upper bag engaging portion and limit the depth of insertion of the bag engaging portion into the recess.

4. A baseball base comprising:

anchor means adapted for positioning in the ground, said anchor means having an upright upper bag engaging portion;

resilient bag means defining a recess in its under surface, the opening leading to the recess being sized less than the size of the largest horizontal cross section through the upper bag engaging portion, such that the portion of the bag surrounding the recess opening stretches as the bag means receives the upper bag engaging portion within the recess to thereby releasably retain the bag means in engagement with the upper bag engaging portion; and the upper bag engaging portion being of rectangular horizontal cross section with truncated corners and the recess having a horizontal cross section of similar shape.

5. A baseball base comprising:

anchor means adapted for positioning in the ground, said anchor means having a horizontal platform and an upright upper bag engaging portion extending upwardly from the platform, said bag engaging portion having an upper horizontal planar anchor surface and anchor walls extending from the platform to the upper surface with flare outwardly;

resilient bag means having internal wall surfaces which define a recess in the undersurface of the bag, such wall surfaces flaring outwardly from the recess opening to a first location within the recess, at such first location said wall surfaces extending inwardly to form a shelf about the perimeter of the recess and thereupon extend upwardly to the top of the recess;

said upper bag engaging portion being insertable into the recess to a depth at which the upper anchor surface engages the shelf and the bottom of the bag means engages the platform so as to releasably and securely mount said bag means to said anchor means; and including plural ribs extending into the recess, from the undersurface of the base, to the depth of the first location, said ribs engaging the upper anchor surface when the bag means is mounted to the anchor means.

* * * * *